US006764140B2

(12) United States Patent
Carson, Jr. et al.

(10) Patent No.: US 6,764,140 B2
(45) Date of Patent: Jul. 20, 2004

(54) DRUM MOUNTING PLATE FOR CUTTING TOOL HOLDER BLOCK

(75) Inventors: Duane E. Carson, Jr., Hollidaysburg, PA (US); Joseph Frear, Bedford, PA (US); Stephen P. Stiffler, New Enterprise, PA (US)

(73) Assignee: Kennametal Inc., Latrobe, PA (US)

( * ) Notice: Subject to any disclaimer, the term of this patent is extended or adjusted under 35 U.S.C. 154(b) by 154 days.

(21) Appl. No.: 10/115,222

(22) Filed: Apr. 1, 2002

(65) Prior Publication Data

US 2003/0184145 A1 Oct. 2, 2003

(51) Int. Cl.[7] ..... E21C 35/19
(52) U.S. Cl. ..... 299/79.1; 299/102; 299/106; 299/104
(58) Field of Search ..... 228/47.1, 49.1; 299/79.1, 39.8, 104, 102, 106

(56) References Cited

U.S. PATENT DOCUMENTS

| | | | | |
|---|---|---|---|---|
| 4,068,897 A | * | 1/1978 | Amoroso | 299/102 |
| 4,650,254 A | | 3/1987 | Wechner | 299/91 |
| 4,897,904 A | | 2/1990 | Cowles | 29/33 K |
| 4,944,560 A | | 7/1990 | Osterwise | 299/91 |
| 4,947,535 A | | 8/1990 | Cowles | 29/428 |
| 5,449,860 A | * | 9/1995 | Buckshaw et al. | 174/67 |
| 5,536,073 A | | 7/1996 | Sulosky et al. | 299/39.8 |
| 5,842,747 A | | 12/1998 | Winchester | 299/87 |

OTHER PUBLICATIONS

Brochure entitled "Road Planing, Soil Stabilization, and Reclamation Tools," Kennametal Inc., (2001), B01–1(12)D1, 43 pages.

* cited by examiner

*Primary Examiner*—John Kreck
(74) *Attorney, Agent, or Firm*—Kevin P. Weldon

(57) ABSTRACT

A cutting tool assembly having a holder block mounting scheme which effectively and accurately positions the cutting tip point at its designed angle of attack. The connection assembly limits undesirable shifting during attachment of the holder block to a cutting drum. The holder block connection assembly of the present invention includes a separate mounting plate that is positioned between the bit holder block and drum/pedestal for accurately aligning the bit holder block onto to the drum/pedestal. Once the bit holder block is aligned into position by the plate as designed the bit holder block is welded to the drum/pedestal.

29 Claims, 2 Drawing Sheets

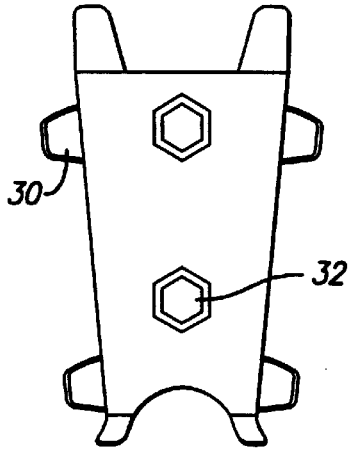
FIG. 4A
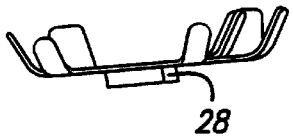
FIG. 4B
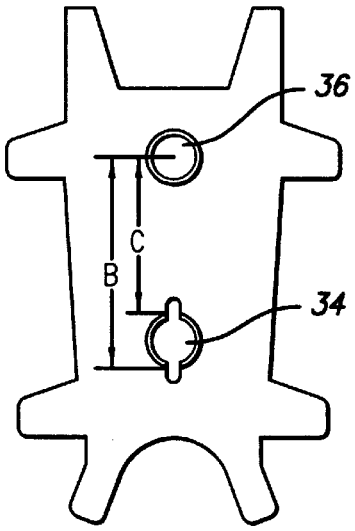
FIG. 5A
FIG. 3A
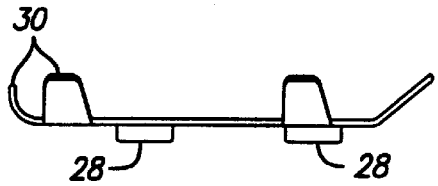
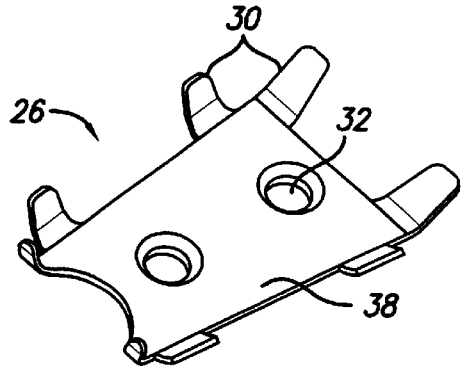
FIG. 3B
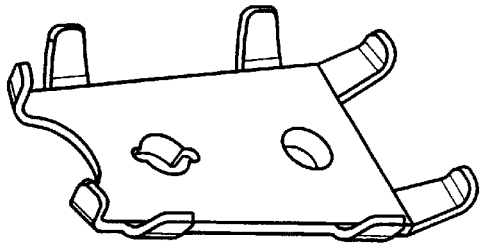
FIG. 5B
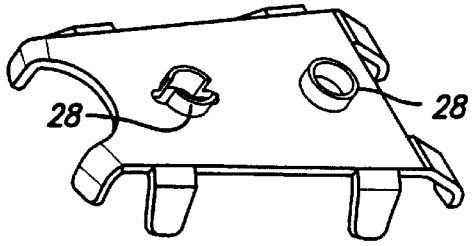
FIG. 5C

DRUM MOUNTING PLATE FOR CUTTING TOOL HOLDER BLOCK

BACKGROUND OF THE INVENTION

1. Field of the Invention

The present invention relates to apparatus for locating a cutting bit on a rotary drum used to cut earth, rock, pavement and the like and, in particular, to an improved cutting lacing method and cutter bit assembly.

2. Background

This invention is directed to locating a plurality of offset points with reference to a peripheral surface or portions of a peripheral surface. Although the invention is to such locating it is believed easier to understand with reference to cutter bits for rotating drums of a coal mining machine for which the invention was initially developed. The methods and apparatus apply to positioning cutter bits on chains for trenchers as well. Inasmuch as the principles of this invention in locating bit points (i.e., the points of the bits) applied to rotary cutting drums, the prior methods and apparatus for locating cutter bits on a rotary drum are discussed for the sake of simplicity in understanding the invention. Diameters and lengths of a cutter drum section vary so that, while the procedures discussed are the same, the tools and aids utilized will vary to compensate for the variations in drum diameter. It is also to be noted that a drum section carries various bit blocks at various locations which receive the bits, and pedestals upon which the bit blocks are mounted. The geometry of the bit blocks and bits is known and, for a specific combination, fixed. Accordingly, such bits and drums are described herein as the presently preferred embodiment of the invention.

In materials mining and in other fields in which a large volume of hard materials must be cut, it is typical to employ an apparatus which includes a vertically moveable horizontal axis cutting drum having cutting bits attached thereto. By virtue of the engagement of the cutting bits which are mounted on the rotating cutting drum with the surface to be cut, material is removed from such surface for further processing.

Due to the substantial forces generated during the cutting operations, the cutting bits must be securely mounted on the cutting drums, but must also be readily removable for replacement. In one prior art form of cutting bit holding apparatus, a cutting bit having an elongated cylindrical shank and a hard cutting tip at one end is retained in a cutter bit holder block which is usually welded directly to the cutting drum or a drum pedestal. A shank receiving bore in the bit holder block is adapted for receiving the shank of the cutting bit therethrough.

Cutter drums vary in design for various mining machines including drums manufactured by a specific manufacturer. As is known, a cutting drum may consist of elongated drum sections, end sections and ring sections between the drum and end sections. The drum, end, and ring segments form a cutter head with various cutter head designs being utilized. Regardless of the design of a cutter head or cutting chain, it is necessary that the cutter head or chain cut its own clearance. That is, the bits on the cutter head cut and break the coal, rock or earth such that the cutter head can be moved forward into a coal seam. In this regard, it is to be noted that coal is a fragile material and that the path of movement of a cutter bit through a coal seam to cause coal breakage is an important aspect of proper lacing of the cutting bits on a drum or cutter chain. Also, each section of a cutter head must carry cutter bits to cut its own clearance. A cutter head which cannot cut clearance for itself is not an acceptable mining machine.

In the mining of coal, it is accepted practice to arrange cutter bits on a traveling or rotating member, such as a cutter chain or a rotating drum, such that the cutting edges or tips of the cutter bits travel through separate paths in the coal seam to be mined. There are various factors regarding the cutting of coal seams which are evaluated by various manufacturers of mining machinery in locating cutter bits on a rotating member including, but not limited to, the hardness and abrasiveness of the material being excavated. The locating of the cutter edges or cutting tip points of a cutter bit is referred to as the "lacing" of a cutter chain or drum and varies among various machinery manufacturers; however, all machinery manufacturers want as accurate locating of the cutter edge or tip point as is possible under the various manufacturing processes.

In the mining and construction industry, the accuracy in connecting a bit holder block to a drum is critical in achieving the designed lacing for the drum. The contact of the conical tip of a cutter bit and the earth strata enhances the rotation of the cutting tool during the road planing operation. The conical tip that actually impinges and rubs against the surface of the earth strata together with the angle of attack enhances or reduces the rotation of the cutting tool. For instance, an increase in the distance that the contact is away from the central longitudinal axis of the hard insert results in an increase in the extent to which such contact encourages rotation of the cutting tool. The angle of attack for cutter bits is designed to optimize rotation of the cutter bit, hence any variation from the designed angle of attack results in a change in the designed rotation characteristics of the cutter bits. Reduced rotation of the cutting tool causes the cutting tool bit to become unevenly worn on one side, for instance, and the cutting bit quickly becomes damaged and inoperative. Such bit holder blocks on rotary drums must be removed and attached back onto the drum. It is well-known in the industry that the accurate lacing of the cutter bits onto a drum is important to the performance of the mining/construction drum. Therefore, the cutter tips must be accurately welded onto the cutting drum or chain. As will be appreciated, such failures of cutter bits are quite costly because the cutting apparatus must be removed from service in order that the remaining portion of the cutter bit can be removed away from the cutting drum and a replacement cutter bit attached.

The typical road milling drum of the past comprises a generally cylindrical drum with a plurality of road milling bit-block assemblies attached to a pedestal or directly to the surface of the drum. More specifically, the holder block, which rotatably holds the bit, is welded to the pedestal or surface of the drum.

In the construction industry for road milling it is essential that that each bit impinges on the road substrate at an exclusive discrete point so that the points of impact span the length of the drum. Typical impact point spacing for road milling has been about 0.625 inches.

In the prior art, methods of locating cutter bit blocks to mining and construction drums have included automated systems that use programmed machines for positioning and welding the blocks in their proper position. U.S. Pat. Nos. 4,897,904 and 4,947,535 disclose automated equipment that places and fixes the tip point with respect to a rotatable drum. The tip point is held in its programmed position at a preselected position by an automated arm having a gripper for grasping the cutter bit holder block. The holder block is welded onto the preselected position. Such automated lacing equipment is expensive and requires skilled technicians to ensure proper programming for the lacing and maintenance of the manufacturing equipment.

When bit holder block location pins were forged perpendicular to the forge parting lines, they were consistent and located the blocks very accurately. For instance, Kennametal' C10AMC block in the Kennametal Road Planing catalogue, catalogue number BO1-1(12)D1, illustrates a block with perpendicular cylindrical pins which effectively positioned a block on the drum. Also see the prior art perpendicular locating pins in U.S. Pat. No. 5,842,747.

A different method to manufacture (forge) bit holder blocks has been developed recently. This new method of forging produces blocks having the block shape shown in FIG. 1 at 10 and marketed in Kennametal' 2001 "Road Planing Soil Stabilization and Reclamation Tools" catalogue, Kennametal Inc., Latrobe Pa., the C10LG block (SAP #: 1012345). The C10LG block is formed by forging the block from steel blanks and stamping out the block shape with reciprocating upper and lower rams. A parting line 23 is formed where the upper and lower rams come together during stamping. The steel is compressed along a reciprocating axis perpendicular to the parting line by the rams. As is well known in the industry, during one-dimensional pressing and stamping processes, it is not possible to form/manufacture a surface oriented at an angle greater than ninety degrees (see dash line perpendicular to parting line 23) with respect to the parting line. Cylindrical pin locator protrusions, therefore, can only be formed projecting from block surfaces perpendicular to the axis of reciprocation of the rams. The cylindrical sidewall of the pins are oriented parallel to the axis of reciprocation of the stamping rams. For instance the cylindrical locator pins on the C10AMC block (SAP 1012285) in the "Road Planing Soil Stabilization and Reclamation Tools" catalogue, Kennametal Inc., Latrobe Pa., show a horizontal parting line and cylindrical locator pins oriented perpendicular to the horizontal parting line. As seen in FIG. 1, the block cannot be formed with locator protrusions 20 in the shape of cylindrical pins. The bottom surface of the block is not perpendicular to the axis of reciprocation of the rams. As can be seen in FIG. 1, the locator protrusions 20 are not cylindrical. The cylindrical locator protrusion must be truncated along surface 21 because a cylindrical surface cannot be formed perpendicular to the bottom surface of the block. Surface 21 as seen in FIG. 1, at best can only be oriented parallel to the axis of reciprocation of the rams.

The locating protrusion in FIG. 1 changed from a cylindrical shape, as on the C10AMC block, to an irregular shape. The irregular shape still locates the C10LG block, but no longer as accurately as the perpendicular cylindrical shape did. The blocks with the irregular shaped locating protrusion would be susceptible to shift up to 1/16" (inch) or more while welding the base of the block to the drum. The 1/16" (inch) shift at the base of the block, it should be recognized, results in an exaggerated shift at the tip point of the cutter bit. Additionally, this inaccuracy and fit play caused by the irregular shape of the locator protrusion results in some blocks being skewed. A slight misalignment at the base of a cutter bit result in a significant shift in the position of the cutter tip point at its very end. A corresponding cutter tip point misalignment of about as much as 1/8" or more occurs at the cutter tip point of some block systems whenever the base is mislocated just 1/16". In addition, the block can be skewed about 4 degrees in either direction out of alignment from its designed position. The skew in the orientation of the block can cause premature wear.

Such inaccuracies in positioning the new forge method blocks on drums causes the cutter tip point to miss the discrete point it was designed to cut by 1/8" inch. Thus, for instance, in the drum lacing example given above of a uniform 0.625 inch spacing, the cutter bit might cut ½ inches away from the adjacent previous tip cut and next succeeding tip will accordingly cut ¾ inches from that cut. The tip that is continually undercutting its fair portion ½ inch as the drum operates often does not make sufficient contact with enough substrate to properly rotate, and the cutter tip that is continually cutting a larger share ¾inch of substrate becomes worn quickest and is more prone to failure than the other tips due to increased fatigue. If two such adjacent blocks are misaligned toward each other, the spacing might be 3/8" (0.625−1/8"−1/8"), or if two adjacent blocks are aligned apart from each other, the spacing therebetween would be 7/8" (0.625+1/8+1/8"), perpetuating such problems discussed immediately above to a greater degree. It is preferred in the industry that each tip along the length of the drum is evenly spaced so that all the tips wear and fail at a uniform rate.

Such 0.625 inch spacing is satisfactory for removing road surfaces in some instances. It is, however, on occasion necessary to design a road milling machine that provides for 0.200 inch spacing to make the texture of the road surface less coarse. Such a smooth texture may be required when resurfacing is not being performed, but the road is being milled to smooth out traffic ruts. A coarse textured surface can be irritating to the driver as a vehicle travels over a coarse cut because of the vibrations and high noise level. For such close spacing used to achieve a smooth textured roadway, it is even more critical to have a method for affixing the cutter bit assemblies to the drum/chain accurately without the need for fixturing.

The subject invention is directed toward an improved bit holder block locating design and method and which overcomes, among others, the above-described problems with prior art bit holder blocks and provides a bit holder block which is much less prone to such failures and the concomitant apparatus downtimes, while being capable of being manufactured at similar costs thereto.

SUMMARY OF THE INVENTION

The subject invention overcomes the problems in the prior art in a cutting tool assembly having a holder block mounting scheme which effectively and accurately positions the cutting tip point at its designed angle of attack.

In accordance with the present invention, there is provided a bit holder block assembly for attachment of a cutting bit to a cutting drum. The cutter bit block assembly includes a separate mounting plate that is positioned between the bit holder block and drum/pedestal for accurately aligning the bit holder block to the drum/pedestal. Once the bit holder block is aligned into position by the plate as designed, the bit holder block is welded to the drum/pedestal.

In one embodiment, an adaptable plate is designed with circular openings at one end and an elongated oval opening at the other end so that locating protrusions with different relative spacing therebetween may be used with the plate. The mounting plate with its oval opening can accommodate block designs with locating protrusions having different spacing.

In another embodiment, the alignment members are hexagonal and cooperate with hexagonal holes on the base/pedestal for fixing the holding block in position.

Accordingly, the present invention provides solutions to the aforementioned problems present with prior art cutting bit holders. These and other details, objects and advantages of the invention will become apparent as the following description of the present preferred embodiment thereof proceeds.

BRIEF DESCRIPTION OF THE DRAWINGS

In the accompanying drawings, there has been shown a present preferred embodiment of the invention wherein:

FIGS. 3A and 3B, respectively, are a side view of the mounting plate and a perspective view of the mounting plate shown in FIG. 2 of the instant invention;

FIGS. 4A and 4B are a top view and perspective side view of a second embodiment of the mounting plate; and FIGS. 5A, 5B and 5C illustrate a third embodiment of a mounting plate with a top view, perspective top view and perspective bottom view, respectively.

DETAILED DESCRIPTION OF THE EMBODIMENTS

The cutting bits which may be employed with the subject invention comprise an elongated shank having a hard cutting tip at one end thereof. As is also known cutter bits have various forms of cutting edges with the conical bit being the preferred form of bit. It is to be realized that the principles of this invention are equally applicable to a linear edged cutting bit since the center of the linear length is equivalent to the tip point of a conical bit. Accordingly, further description of this invention is with reference to a conical bit having a tip point.

Figure 1:
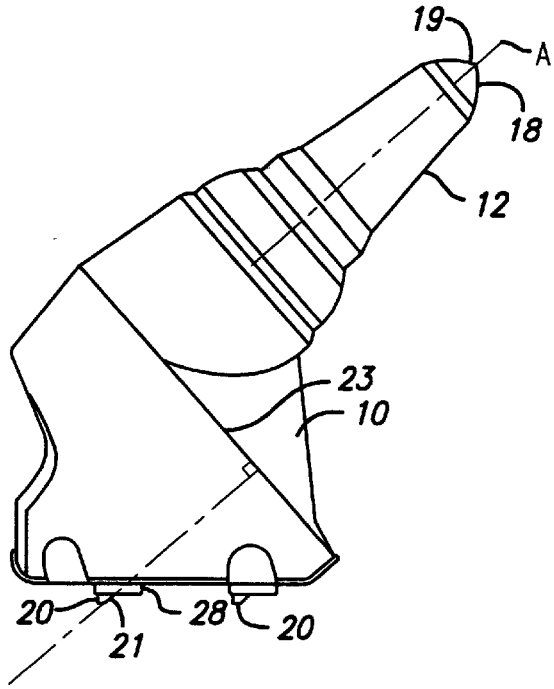
FIG. 1 is a side view of the cutter bit assembly of the present invention.

Referring now to the drawings wherein the showings are for purposes of illustrating the present preferred embodiments of the invention only and not for purposes of limiting same, FIG. 1 shows a cutting bit holder block 10 for supporting a cutting bit 12 on a rotatable cutting drum or other driven element. The cutting bit 12 includes an elongated shank which defines an axis A—A, having at one end a conical tip 18 forming a tip point 19 at its forward end.

Figure 2:
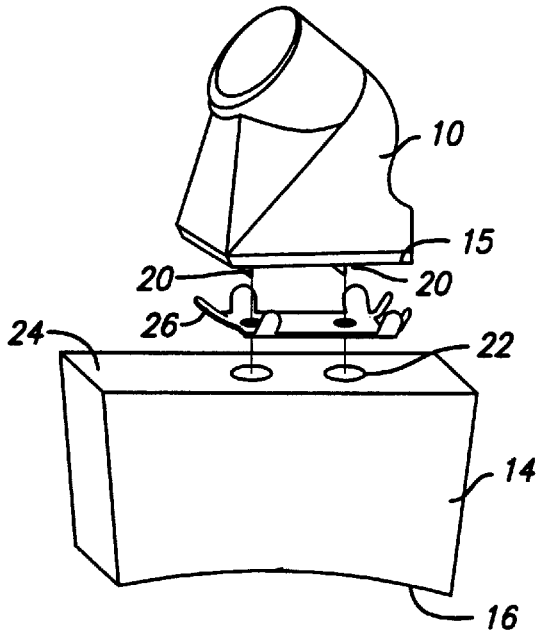
FIG. 2 is an exploded view of the connection assembly of including the bit holder block, mounting plate and a pedestal.

More particularly and with reference to FIG. 2, an exploded view of the connection assembly is shown including a cutting bit holder block 10, a mounting plate 26, and a pedestal 14 that has a bottom 16 for being integrally fixed to a rotary mining/construction drum. Specifically, bit holder block 10 is mounted by welding or a similar attaching means to a pedestal 14 which is integrally fixed to the rotary drum (not shown) typically by welding. In the invention, a mounting plate 26 is positioned between the pedestal 14 and block 10. The mounting plate 26 is assembled to the block first as shown in FIG. 1 and then positioned into alignment with the fixture holes 22 in the pedestal. The block, plate and pedestal are then welded together. Weld material is applied around the bottom circumference of the block. The bottom of the block is typically chamfered 15 for receiving weld material. The plate 26 is made of a low temperature steel so that during the process of welding the bottom periphery of the block to the pedestal, the tabs 30 are melted off and a weld is formed along the entire circumference of the bottom of the block. The attachment of the holder block 10 to a pedestal is for purposes of illustrating the invention and is not to limit the scope of the invention. The holder block 10 could be directly attached to a drum (no pedestal) having fixture holes 22 machined directly into the circumferential surface of the drum.

The mounting plate alignment members 28 are designed to snugly fit into the alignment holes 22 so that no loose play exists between the plate and pedestal. The tight no tolerance fit ensures that the mounting plate 26 is affixed to the drum/pedestal in its designed exact location. The mounting plate is made of non-heat treated steel which can be precisely stamped out in accordance with its blueprint design within very small tolerances. The mounting plate can be made from an SAE 1010, 1018 or A36 grade steel. It will be appreciated that, for this embodiment and each of the embodiments disclosed herein, the bit holder block 10 may be mounted directly on the rotary cutting drum rather than onto a pedestal.

The mounting plate has a bottom 38 contoured to the bottom of the block base forging and a plurality of bent tabs 30 that are tightly contoured to the base of the block. Similar to the alignment members 28 the tabs can be stamped out and shaped with high accuracy within very precise tolerance limits. As seen in FIG. 1, the tabs smoothly cooperate with the bottom of the holder block. The cooperation of the tabs with the bottom contour of the block provides for a very exact connection of the block to the mounting plate 26 upon welding. Openings 32 in the mounting plate alignment members, in conjunction with the locating protrusions 20, help secure the plate as well, but are not necessary. It should be noted that since the bent tabs help secure the plate to the block during welding, the design of a plate can be altered to fit a number of block styles, which blocks may or may not have locator protrusions 20. Typically, the bottom surface of a block is generally flat except for the locator protrusions. For instance, a mounting plate can be designed to accommodate a bit holder block with locator protrusions or without protrusions. Along these lines it should be apparent that the geometric shape of the locator protrusions is not significant or critical to the function or scope of the invention. Additionally, the shape of the alignment members 28 are sized and shaped to provide a snug fit into locating holes on drums/pedestals and the tabs in cooperation with the contour of the holder block base achieve precise positioning of the cuter tip points. This is the same general method of locating tip points on the new forged irregular shaped locating protrusions in the prior art as discussed above accept for the improvement in accuracy.

FIGS. 4A and 4B illustrate a second alternative mounting plate embodiment to FIGS. 3A and 3B, which have hexagonal alignment members that are designed to cooperate in conjunction with alignment holes on the pedestal (or drum itself) that are hexagonal. Like the embodiment in FIGS. 1–3 and described above the hexagonal shaped alignment members can be stamped out with great accuracy so that the cutter tip block assembly is precisely positioned on a rotary drum. The geometries of the cooperating alignment members and base apertures is not to be limited to circular or hexagonal shapes but it is contemplated that many different shapes and sizes could also be employed. In general the alignment member must have vertical sidewalls that snugly fit against vertical sidewalls of the fixture holes 22. The cooperating vertical walls of the alignment member and fixture hole form cooperating contact between the alignment member and fixture hole for the majority of the inner circumference of the fixture hole so as to prevent undesirable shifting.

A third embodiment is shown in FIGS. 5A–5C, and as best seen in FIG. 5A has a plate formed with a circular aperture 36 and elongated oval aperture 34. The oval aperture allows for variations in the relative distance between the locating protrusions 20 on blocks. With the third embodiment illustrated in FIGS. 5A–5C, holder blocks with varying distances between the locating protrusions can be employed with this mounting plate. The forward locating protrusion nearest the cutting bit is inserted into aperture 36, first and the second protrusion is then positioned in the oval aperture. The width of the oval opening is manufactured to snugly guide onto the locating protrusion, and the elongated length for the oval aperture permits for accommodating locating protrusions of different size in length and/or spacing therebetween. In FIG. 5A, the minimum allowable spacing between the locating protrusions on the block 10 is shown as distance "C"and the maximum distance between the two protrusions is represented by "B." FIG. 5C best illustrates the alignment members. As seen in FIG. 5C, the alignment member 28 that corresponds to the aperture 36 is a complete ring; however, the alignment member 28 that extends from the oval aperture is in the shape of two symmetric crescents. The two arcuate crescents are received in one cylindrical hole on a drum/pedestal and the complete ring alignment member is received in a second cylindrical hole similar to the embodiment shown in FIGS. 1–3.

The plate has a bottom surface 38 that is attached to the circumferential surface of the rolling drum. The surface may be either flat, as shown in FIG. 4, or have a radius of curvature that corresponds to the radius of curvature of the rolling drum.

It is contemplated that instead of the tabs shown in each of the mounting plate embodiments, side rails (walls) could be employed to accurately position the bottom of a block onto the mounting plate. Such side rails along the base of an assembled product are well-known in the industry and used in the manufacturing of a large variety of products.

There are additional benefits and advantages in using a mounting plate assembly to accurately align a bit holder block. Block, pedestal and drums typically are made from harder steels due to the harsh, violent environment these elements are placed into. For instance, blocks are typically made form SAE 4140 steel. One disadvantage of these hard metal steels is that they do not lend themselves to being materials that form strong weld joints. The mounting plate, in addition to assisting in more accurately positioning a block on a rotary drum, it is believed also provides for a stronger weld joint by relieving some of the weld stress, which can build during cooling and contraction of the joint. It is believed that, since the mounting plate is made from a more ductile material than the block or pedestal, it is more flexible and enhances the flexibility of the joint so that the joint may better contract and compress during cooling of the weld.

It will be understood that various changes in the details, materials and arrangements of parts which have been herein described and illustrated in order to explain the nature of the invention may be made by those skilled in the art within the principle and scope of the invention as expressed in the appended claims. It is intended that equivalents, adaptations and modifications reasonably inferable from the invention described herein be included within the scope of the invention as disclosed.

What is claimed is:

1. A mounting plate for aligning bit holder block onto a drum comprising:

a bottom;

a plurality of tabs; and an alignment member, wherein said tabs are for locating said block into position and said alignment member is for accurately aligning said plate on the drum.

2. The mounting plate according to claim 1 wherein said plate contains at least one additional alignment member.

3. The mounting plate according to claim 1 further comprising an opening in said bottom whereby locating protrusions can be received.

4. The mounting plate according to claim 3 wherein said bottom includes at least one additional opening.

5. The mounting plate according to claim 4 wherein one of said openings is elongated.

6. The mounting plate according to claim 5 wherein one of said openings is circular.

7. The mounting plate according to claim 3 wherein said opening is hexagonal.

8. The mounting plate according to claim 4 wherein said bottom has eight tabs.

9. The mounting plate according to claim 1 wherein said plurality of tabs are connected to said bottom and said plate has at least four tabs.

10. A connection assembly for connecting a holder block to a drum comprising:

a holder block;

a mounting plate; and at least one fixture hole whereby said holder block, mounting plate and at least one fixture hole assist in accurately positioning said block onto the drum, wherein said mounting plate includes a plurality of tabs adapted to receive said holder block.

11. The connection assembly according to claim 10 wherein said holder block has a generally flat bottom surface.

12. The connection assembly according to claim 10 wherein said holder block has at least one locator protrusion.

13. The connection assembly according to claim 10 wherein said holder block has at least two locator protrusions.

14. The connection assembly according to claim 10 wherein said mounting plate includes at least one alignment member.

15. The connection assembly according to claim 14 wherein said at least one alignment member is received in said at least one fixture hole.

16. The connection assembly according to claim 15 wherein said mounting plate includes at least one elongated opening.

17. The connection assembly according to claim 10 wherein said mounting plate includes at least one alignment member.

18. The connection assembly according to claim 17 wherein said at least one alignment member is generally cylindrical.

19. The connection assembly according to claim 17 wherein said mounting plate has a generally flat bottom.

20. The connection assembly according to claim 17 wherein said at least one alignment member has a vertically oriented sidewall.

21. The connection assembly according to claim 20 wherein said at least one alignment member is received in at least one said fixture hole to prevent shifting.

22. A connection assembly for connecting a holder block to a drum comprising:

a mounting plate, a plurality of fixture holes; and a holder block, wherein said holder block includes a plurality of alignment members and a plurality of tabs, said tabs on said mounting plate conform in shape to a bottom of said holder block so that said block fits into said mounting plate in a tight manner, said alignment members are adapted to be received in said fixture holes in a snug manner so as to prevent shifting of said mounting plate.

23. The connection assembly according to claim 22 wherein said holder block and mounting plate are welded directly onto a drum.

24. The connection assembly according to claim 22 wherein said holder block and mounting plate are welded onto a drum pedestal.

25. The connection assembly according to claim 22 wherein said alignment members are generally cylindrical.

26. The connection assembly according to claim 22 wherein said mounting plate includes an elongated opening.

27. The connection assembly according to claim 22 wherein said at least one alignment member has a vertically oriented sidewall.

28. The connection assembly according to claim 27 wherein said fixture holes have vertical sidewalls that are adapted to contact said alignment member vertical sidewalls so as to prevent undesirable shifting.

29. The connection assembly according to claim 22 wherein said it least one alignment member has a circumferential wall that contacts at least one of said fixture holes.

* * * * *